US005678917A

United States Patent [19]

Bergkvist

[11] Patent Number: 5,678,917

[45] Date of Patent: Oct. 21, 1997

[54] METHOD FOR PROVIDING A WHITE COLOR UPON ILLUMINATION OF A FLUORESCENT OBJECT WITH ULTRAVIOLET LIGHT

[75] Inventor: Lars A. Bergkvist, Själevad, Sweden

[73] Assignee: Ultralux AB, Göteborg, Sweden

[21] Appl. No.: 535,050

[22] PCT Filed: Apr. 27, 1994

[86] PCT No.: PCT/SE94/00377

§ 371 Date: Oct. 30, 1995

§ 102(e) Date: Oct. 30, 1995

[87] PCT Pub. No.: WO94/25951

PCT Pub. Date: Nov. 10, 1994

[30] Foreign Application Priority Data

Apr. 29, 1993 [SE] Sweden ..... 9301457

[51] Int. Cl.[6] ..... F21V 9/16

[52] U.S. Cl. ..... 362/84; 362/812; 40/543

[58] Field of Search ..... 362/84, 812; 40/543; 116/1

[56] References Cited

U.S. PATENT DOCUMENTS 5,398,174 3/1995 Fast ..... 362/84

5,436,812 7/1995 Stewart ..... 362/84 X

*Primary Examiner*—Stephen F. Husar

*Attorney, Agent, or Firm*—Alfred J. Mangels

[57] ABSTRACT

A method for compensating color when illuminating fluorescent objects by means of one or more illuminating lamps which emit a significant amount of ultraviolet light, particularly when illuminating flags hoisted on flag poles, wherein the objects include ultralight fluorescent material and have a white or a light color when illuminated with visible light. The object is provided with an additional fluorescent material which when illuminated fluoresces in a color that together with a weak blue color provides a white or essentially white color by additive color mixture, the blue color being derived by illumination of the object with ultraviolet light.

7 Claims, No Drawings

METHOD FOR PROVIDING A WHITE COLOR UPON ILLUMINATION OF A FLUORESCENT OBJECT WITH ULTRAVIOLET LIGHT

BACKGROUND OF THE INVENTION

1. Field of the Invention

The present invention relates to a method for compensating for color when illuminating fluorescent objects that fluoresce when illuminated with ultraviolet light.

The objects concerned may be of diverse kinds, such as different signs that have different functions, road markers, sea markers, etc. Flags are objects of primary interest.

2. Description of the Related Art

Swedish Patent Specification No. 9200250-0 relates to a method for illuminating flags hoisted on flag poles, particularly advertising flags of the kind that are placed along automobile routes in the vicinity of restaurants, hotels, gas filling stations. The invention defined in this patent specification is characterized by illuminating one or more flags which include ultralight fluorescent material by means of one or more illuminating lamps which emit a significant percentage of ultraviolet light.

Such flags are used to a large extent to mark the presence of hotels, filling stations, restaurants, etc., among other things. Often there is a desire to amplify the effect by placing a number of flags adjacent to one another, and often on relatively high flag poles. The intention is to draw the attention of motorists to the presence of a filling station or a rest station in good time before the motorist reaches the particular station concerned. Such flags can be seen relatively well in the daylight hours. The flags are relatively normally illuminated by illuminating lamps during the darker of the day. The illuminating effect is restricted by the fact that the flags normally take-up only a small part of the light cone of the lamps, therewith illuminating the flags only to a limited extent.

The flags are made visible to a very great extent when illuminated with ultraviolet light, therewith enabling the flags to be seen much more clearly during the dark hours of the day.

A very large part of flags of this nature, such as advertising flags, are often white in color, for instance having a white background. It is relatively usual to produce advertising flags and the like from a white fabric on which different trade names and/or text are printed.

One serious problem is that when illuminating fluorescent flags that are comprised of a white fabric, the fluorescence effect obtained is always more blue than white. The same applies to fluorescent white paints, dyes and plastics.

This problem is mainly due to two thing. Lamps that emit ultraviolet light and are capable of being used in practice include a filter which functions to filter-out visible light. Firstly, the filter allows a certain amount of visible blue light to pass through and this light is reflected by the fabric as it impinges thereon. The fabric is therewith seen to be blue by the eye of the viewer. Secondly, white fluorescent pigment is often comprised of a so-called optical whitening agent which fluoresces in a spectrum that has dominance in the visible blue range.

Consequently, a flag for instance which is intended to be white end which is seen to be white in daylight will no longer be seen as white when illuminated with ultraviolet light during the dark hours, but will be seen as varying degrees of blue. There is a strong desire for flags to be seen as white even when illuminated with ultraviolet light. The same problem is found with objects other than flags.

An object of the present invention is to solve this problem.

SUMMARY OF THE INVENTION

Accordingly, the present invention relates to a method of compensating for color when illuminating fluorescent objects with the aid of one or more illuminating lamps which emit a significant amount of ultraviolet light, particularly when illuminating flags that are hoisted on flag poles, wherein the objects include ultralight fluorescent material and have a white or light color when illuminated with visible light. The method therefor characterized by including in the object an additional fluorescent material which when illuminated fluoresces in a color which together with a weak blue color, the blue color deriving from illumination of the object with ultraviolet light, will produce a white or essentially white color by additive color mixture.

DESCRIPTION OF THE PREFERRED EMBODIMENTS

The invention will now be described in more detail with reference to an exemplifying embodiment thereof applied to flags, although it will be understood that the invention is not restricted to flags, but includes all manner of objects.

The present invention relates to a method of color compensation when illuminating fluorescent objects by means of one or more illuminating lamps which emit a significant amount of ultraviolet light, particularly when illuminating flags that are hoisted on flag poles. Such objects including ultralight fluorescent material and having a white or light color when illuminated with visible light.

The invention is particularly concerned with advertising flags of the kind that are placed along automobile routes in the vicinity of restaurants, hotels and filling stations The invention, however, can be applied to objects other than flags, for instance marquees, banderoles, different types of signs or road or sea markers.

Objects with which the invention can be applied are light in color, i.e. white objects or objects in a light color. By light color is meant a color which is so light that the blue light deriving from illumination of the object with lamps that emit ultraviolet light will be seen with the naked eye.

Even though the aforesaid problem is greatest when the object concerned is white, the problem also occurs with color other than white. For instance, a light red color tends to shift to violet as a result of the contribution of the blue light.

According to the invention, the object is caused to include an additional fluorescent material which when illuminated fluoresces in a color which together with the weak blue color, said blue color deriving from the illumination of the object with ultraviolet light, will produce a white or essentially white color by additive color mixture.

By additive color mixture is meant that the weak visible blue light mixes additively with the visible light emitted by the additional fluorescent material.

According to one preferred embodiment of the invention, the additional fluorescent material fluoresces in a yellow color. This means that the blue light that derives from illuminating the object with ultraviolet light mixes additively with the visible yellow light that derives from the yellow light emitted through fluorescence to a light which is observed to be white by the naked eye.

According to another preferred embodiment of the invention, the additional fluorescent material is colorless or white when illuminated with visible light. A colorless material will mean that the color of the object will not be influenced by the additional material when illuminating with visible light. A white additional material is primarily intended for objects that are white when illuminated with visible light.

There are commercially available large numbers of fluorescent pigments, both organic and inorganic pigments, which are suitable for use when practicing the invention, irrespective of whether the invention is applied for color compensation of fabrics, paints or plastics. The person skilled in this art will therefore have no problem in choosing a suitable fluorescent pigment for the additional material according to the invention, and to dose this material so that the light emitted as it fluoresces will compensate the aforesaid blue light.

It can be mentioned by way of example that a material which fluoresces in a yellow color and which is suitable for compensating the aforesaid blue light when the objects concerned are white flags is manufactured by Hoechst AG in Germany under the designation CD 704, and by Riedel-de-Haen in Germany under the designation CD 404, among other manufacturers.

The additional material can be applied in several conventional ways. For instance, fabrics can be dipped in a slurry containing the additional material. The additional material may also be printed onto the fabric. With regard to other objects, for instance plastic objects such as signs, the additional material may be admixed with the plastic, as is also the remaining fluorescent material.

The present invention solves the problem mentioned in the introduction, irrespective of whether or not the blue light is derived solely from the lamp that transmits ultraviolet light, or is derived solely from the fluorescent material that is included in the object to provide the intended fluorescence effect, or is derived from both of these sources.

It will be understood that the present invention is not restricted to the aforedescribed embodiments and that modifications can be made within the scope of the following Claims.

What is claimed is:

1. A method for compensating for blue color that is emitted when illuminating light colored fluorescent objects by one or more illuminating lamps that emit a significant amount of ultraviolet light, said method comprising: providing an object that includes ultralight fluorescent material and that is opaque to ultraviolet light, said object having a light color when illuminated with visible light and emitting a blue color when illuminated with ultraviolet light, and providing the object with an additional fluorescent material which fluoresces in a yellow color when illuminated with ultraviolet light to produce substantially a white color by additive color mixture of the fluorescent yellow color with the blue color imparted to the material by illumination of the material with ultraviolet light.

2. A method according to claim 1, wherein the additional fluorescent material is colorless when illuminated with visible light.

3. A method according to claim 1, wherein the additional fluorescent material is white when illuminated with visible light.

4. A method according to claim 1, wherein the material is white in color.

5. A method according to claim 1, wherein the material is opaque to both visible and ultraviolet light.

6. A method according to claim 1, wherein the material is a white fabric.

7. A method according to claim 1, wherein the object is a flag.

* * * * *